US010487468B2

(12) United States Patent
Niroumand

(10) Patent No.: US 10,487,468 B2
(45) Date of Patent: Nov. 26, 2019

(54) MANDREL AND A METHOD FOR SOIL COMPACTION

(71) Applicant: Bahman Niroumand, Bushehr (IR)

(72) Inventor: Bahman Niroumand, Bushehr (IR)

( * ) Notice: Subject to any disclaimer, the term of this patent is extended or adjusted under 35 U.S.C. 154(b) by 0 days.

(21) Appl. No.: 16/207,088

(22) Filed: Dec. 1, 2018

(65) Prior Publication Data

US 2019/0100892 A1 Apr. 4, 2019

Related U.S. Application Data

(60) Provisional application No. 62/593,887, filed on Dec. 2, 2017.

(51) Int. Cl.

| | |
|---|---|
| ***E02D 3/08*** | (2006.01) |
| ***E21B 1/00*** | (2006.01) |
| ***E02D 3/054*** | (2006.01) |

(52) U.S. Cl.

CPC ..... *E02D 3/08* (2013.01); *E02D 3/054* (2013.01); *E21B 1/00* (2013.01)

(58) Field of Classification Search

CPC ..... E02D 3/08
USPC ..... 404/133.05, 133.1, 133.2; 405/231–233, 405/271

See application file for complete search history.

(56) References Cited

FOREIGN PATENT DOCUMENTS

| | | | |
|---|---|---|---|
| GB | 2286613 | * | 8/1995 |
| JP | 2013-159987 | * | 8/2013 |

* cited by examiner

*Primary Examiner* — Sunil Singh
(74) *Attorney, Agent, or Firm* — Bajwa IP Law Firm; Haris Bajwa

(57) ABSTRACT

A method and a mandrel for forming a cavity at a target location. The mandrel may include a main drilling shaft, a plurality of T-shaped elements, a hollow-cylindrical-shaped element, and a plurality of parallelepiped-shaped stiffener plates. The main drilling shaft may include a hammer insertion part positioned at a first end of the main drilling shaft, a bore head positioned at a second end of the main drilling shaft, and a medium part positioned between the hammer insertion part and the bore head. The plurality of T-shaped elements may be mounted adjacently around the medium part in a way such that forming a closed octagonal from a top-view of the mandrel. A first size of a first cross-section at a first location from a top-view of the plurality of T-shaped elements around the medium part may be larger than a second size of a second cross-section at a second location from the top-view.

19 Claims, 15 Drawing Sheets

600

104

104

162

600

MANDREL AND A METHOD FOR SOIL COMPACTION

CROSS-REFERENCE TO RELATED APPLICATION

This application claims the benefit of priority from U.S. Provisional Patent Application Ser. No. 62/593,887 filed on Dec. 2, 2017, and entitled "PYRAMIDAL MANDREL FOR SOIL COMPACTION, AND METHOD OF USE FOR MAKING AGGREGATE PIERS" which is incorporated herein by reference in its entirety.

TECHNICAL FIELD

The present disclosure generally relates to soil compaction systems and methods, and particularly to a mandrel and a method for compacting soil at a target location.

BACKGROUND

In current civil engineering and building construction practice, many structures ranging from residential houses to high-rise buildings are built on deep foundation systems, such as piles or drilled piers, which extend to rock or stronger soils to support the building. This is often necessary because soil near the surface frequently are inadequate for supporting the building upon a shallow foundation. These deep foundations tend to be rather expensive compared to shallow foundations and are typically necessary where the near-surface soils include soft to stiff clays, silts, sandy silts, loose to firm silty sands and sands. In most shallow foundations, the amount of settlement tolerable (influenced by the soil's compressibility) controls the usefulness of the shallow foundation, rather than the ultimate load-bearing capacity (strength). For some situations where the near-surface soils are inadequate or marginal for supporting shallow foundations, the in situ soils can be stiffened with reinforcement, such as short aggregate piers. This allows shallow foundations or smaller footings to be used in circumstances where there are space limitations. In either instance, a substantial cost saving can be realized using short aggregate piers to reinforce the near-surface soils.

Similar improvements in subgrade, subbase, and base materials beneath highways, railroads, and runways can result in substantial savings in construction costs. For example, in most highways that are in weak soil sites, the in-situ soil is probably incapable of adequately supporting a thin pavement wearing surface. The traditional solution is to excavate the existing soil to a certain depth, usually between four and twenty-four inches and replace the removed material with a material having greater load-bearing capabilities in a combination of compacted subbase to reduce potential damage from traffic caused by the poor load-bearing characteristics of the subgrade soil. In either event, a substantial cost is associated with the excavation and replacement or with the increased thickness of the wearing surface.

There are two well-known methods for producing a type of deep soil reinforcement known commonly as "stone columns" in situ to strengthen weak soils. These two methods are the so-called "vibro-replacement" and the "vibro-displacement" methods. Each of these methods leads to an improvement in the load-bearing capability of the ground, rather than producing a piling resting on bedrock, although stone columns are relatively deep and are often extended to stronger subsoils or even to bedrock.

The vibro-replacement technique (also known as the "wet-method") involves jetting a hole into the ground to a desired depth using a vibratory probe (for example, Vibroflot). The jetting is normally accomplished by forcing liquid under great pressure through a lower end of the probe to loosen and cut the soil and by forcing the probe downwardly into the ground. The uncased hole is then flushed out and, typically, uniform graded stone (stone which has been graded to have a relatively uniform particle size) is placed in the bottom of the hole in increments and is compacted by raising and lowering the probe, while at the same time vibrating the probe. The vibro-replacement method is characterized by relatively high cost owing to the rather heavy and specialized nature of the equipment necessary to carry out the method. This has tended to limit the use of the method to relatively large and expensive projects. Also, this technique can have a negative impact on the local environment due to the large quantities of water that are typically used in the process. This causes difficulties in disposing of the excess water and typically results in pools of standing water collected near the constructed columns. These pools of water can impede construction efforts at the site and add additional cost to the construction.

The second of the above-identified common methods of producing relatively deep stone columns in the ground is known as the "vibro-displacement" or dry method. In the vibro-displacement method, a vibratory probe is forced downwardly into the ground, displacing soil by compaction downwardly and laterally. Moreover, compressed air may be forced through the tip pf the probe to ease penetration into the ground. Once the probe has reached the desired depth, the probe is withdrawn and backfill is added to the hole, the backfill typically being drawn from the site itself. The backfill is then compacted using the probe.

Several iterations of the filling and compacting steps typically are required to produce a deep stone column that has improved load-bearing characteristics as compared with the naturally occurring surrounding soil. The vibro-displacement method also suffers from requiring heavy specialized construction equipment and is generally best suited for improving firmer soils.

Each of the above-described methods for creating deep stone columns or granular columns, and other known techniques for producing stone or granular columns in relatively weak soils may be associated with some issues such as failing to fully exploit the increased load-bearing capacity of the soil surrounding the stone columns if the soil were to be significantly presented and densified, as by high energy lateral impact stress. This failure to laterally pre-stress or compact the surrounding soil to a significant degree is noteworthy because such stone or granular columns are relatively cohesionless, and while being stiffer than the surrounding soil, the columns derive much of their load-bearing capability from the surrounding lateral soil.

Therefore, there is a need for a method of producing reinforcing elements in-situ in soils wherein the surrounding lateral soil adjacent the resulting reinforcing elements are significantly pre-stressed and compacted to improve the load-bearing capability of the reinforcing element, while at the same time being capable of being carried out with relatively inexpensive and simple equipment.

SUMMARY

This summary is intended to provide an overview of the subject matter of the present disclosure and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments, the present disclosure describes an exemplary mandrel for forming a cavity at a target location. In one or more exemplary embodiments, the mandrel may include a main drilling shaft, a plurality of T-shaped elements, a hollow cylindrical-shaped element, and a plurality of parallelepiped-shaped stiffener plates.

In one or more exemplary embodiments, the main drilling shaft may include a cylindrical-shaped structure. Furthermore, the main drilling shaft may include a hammer insertion part positioned at a first end of the main drilling shaft, a bore head positioned at a second end of the main drilling shaft, and a medium part positioned between the hammer insertion part and the bore head.

In one or more exemplary embodiments, the bore head may be configured to tamper through hard rock surfaces. In one or more exemplary embodiments, the plurality of T-shaped elements may be mounted adjacently around the medium part of the main drilling shaft. In one or more exemplary embodiments, the plurality of T-shaped elements may form a closed octagonal from a top-view of the mandrel.

In one or more exemplary embodiments, a first size of a first cross-section at a first location from a top-view of the plurality of T-shaped elements around the medium part may be larger than a second size of a second cross-section at a second location from the top-view. In one or more exemplary embodiments, the first location may be closer to hammer insertion part and the second location may be closer to the bore head.

In one or more exemplary embodiments, each respective T-shaped element of the plurality of T-shaped elements may include a first trapezoid-shaped plate including a trapezoid face, and a second trapezoid-shaped plate. In one or more exemplary embodiments, the second trapezoid-shaped plate may include a first edge and a second edge. Furthermore, the second trapezoid-shaped plate may be attached at the first edge of the second trapezoid-shaped plate to the trapezoid face of the first trapezoid-shaped plate.

In one or more exemplary embodiments, the hollow cylindrical-shaped element may be mounted onto the main drilling shaft. Furthermore, the hollow cylindrical-shaped element may include a main drilling shaft insertion hole, a hollow-cylindrical section including a top surface and a bottom surface, and a hollow-beveled section. In one or more exemplary embodiments, the hollow-beveled section may include a large-diameter circular surface and an outer beveled surface. Furthermore, the hollow-beveled section may be attached at the large-diameter circular surface to the bottom surface of the hollow cylindrical section.

In one or more exemplary embodiments, the plurality of parallelepiped-shaped stiffener plates may be mounted around the medium part of the main drilling shaft. Furthermore, each respective parallelepiped-shaped stiffener plate of the plurality of parallelepiped-shaped stiffener plates may include a third edge and a fourth edge. In one or more exemplary embodiments, each parallelepiped-shaped stiffener plate of the plurality of parallelepiped-shaped stiffener plates may be attached at the third edge to the outer beveled surface of the hollow-beveled section. In one or more exemplary embodiments, each parallelepiped-shaped stiffener plate of the plurality of parallelepiped-shaped stiffener plates may be attached at the fourth edge to the medium part of the main drilling shaft.

In one or more exemplary embodiments, the hollow cylindrical-shaped element may be attached at the top surface of the hollow-cylindrical section to a bottom end of the plurality of T-shaped elements. In one or more exemplary embodiments, the bore head may comprise a wedge-shaped tip. In one or more exemplary embodiments, a diameter of the hammer insertion part may correspond to a size of a mechanical vibratory hammer.

According to one or more exemplary embodiments, the present disclosure describes also a method for forming a cavity at a target location. In one or more exemplary embodiments, the method may include a first step of positioning a mandrel above the target location.

In one or more exemplary embodiments, the mandrel may include a main drilling shaft, a plurality of T-shaped elements, a hollow cylindrical-shaped element, and a plurality of parallelepiped-shaped stiffener plates.

In one or more exemplary embodiments, the main drilling shaft may include a cylindrical-shaped structure. Furthermore, the main drilling shaft may include a hammer insertion part positioned at a first end of the main drilling shaft, a bore head positioned at a second end of the main drilling shaft, and a medium part positioned between the hammer insertion part and the bore head.

In one or more exemplary embodiments, the bore head may be configured to tamper through hard rock surfaces. In one or more exemplary embodiments, the plurality of T-shaped elements may be mounted adjacently around the medium part of the main drilling shaft. In one or more exemplary embodiments, the plurality of T-shaped elements may form a closed octagonal from a top-view of the mandrel.

In one or more exemplary embodiments, a first size of a first cross-section at a first location from a top-view of the plurality of T-shaped elements around the medium part may be larger than a second size of a second cross-section at a second location from the top-view. In one or more exemplary embodiments, the first location may be closer to hammer insertion part and the second location may be closer to the bore head.

In one or more exemplary embodiments, each respective T-shaped element of the plurality of T-shaped elements may include a first trapezoid-shaped plate including a trapezoid face, and a second trapezoid-shaped plate. In one or more exemplary embodiments, the second trapezoid-shaped plate may include a first edge and a second edge. Furthermore, the second trapezoid-shaped plate may be attached at the first edge of the second trapezoid-shaped plate to the trapezoid face of the first trapezoid-shaped plate.

In one or more exemplary embodiments, the hollow cylindrical-shaped element may be mounted onto the main drilling shaft. Furthermore, the hollow cylindrical-shaped element may include a main drilling shaft insertion hole, a hollow-cylindrical section including a top surface and a bottom surface, and a hollow-beveled section. In one or more exemplary embodiments, the hollow-beveled section may include a large-diameter circular surface and an outer beveled surface. Furthermore, the hollow-beveled section may be attached at the large-diameter circular surface to the bottom surface of the hollow cylindrical section.

In one or more exemplary embodiments, the plurality of parallelepiped-shaped stiffener plates may be mounted around the medium part of the main drilling shaft. Furthermore, each respective parallelepiped-shaped stiffener plate of the plurality of parallelepiped-shaped stiffener plates may include a third edge and a fourth edge. In one or more exemplary embodiments, each parallelepiped-shaped stiffener plate of the plurality of parallelepiped-shaped stiffener plates may be attached at the third edge to the outer beveled surface of the hollow-beveled section. In one or more exemplary embodiments, each parallelepiped-shaped stiffener plate of the plurality of parallelepiped-shaped stiffener plates may be attached at the fourth edge to the medium part of the main drilling shaft.

In one or more exemplary embodiments, the hollow cylindrical-shaped element may be attached at the top surface of the hollow-cylindrical section to a bottom end of the plurality of T-shaped elements. In one or more exemplary embodiments, the bore head may comprise a wedge-shaped tip. In one or more exemplary embodiments, a diameter of the hammer insertion part may correspond to a size of a mechanical vibratory hammer.

In one or more exemplary embodiments, the method may also include a second step of generating a conical-shaped cavity by driving the mandrel into the target location, a third step of extracting the mandrel from the conical-shaped cavity, a fourth step of generating an aggregate filled conical-shaped cavity by filling the conical-shaped cavity with aggregate, a fifth step of compacting the aggregate filled conical-shaped cavity by ramming a first hammering device onto a top surface of the aggregate filled conical-shaped cavity, a sixth step of covering the filled conical-shaped cavity with a layer of the aggregate, and a seventh step of compacting the layer of the aggregate by ramming a second hammering device onto a top surface of the layer of the aggregate.

In one or more exemplary embodiments, the second step of generating a conical-shaped cavity by driving the mandrel inside the target location may include generating a conical-shaped cavity by driving the mandrel inside the target location utilizing a mechanical vibratory hammer.

In one or more exemplary embodiments, the fourth step of generating an aggregate filled conical-shaped cavity may include filling the conical-shaped cavity with one of a gravel material, a loose sandy soil, a clayey soil, a medium density soil, a hard rock soil, and combination thereof.

In one or more exemplary embodiments, the fifth step of compacting the aggregate filled conical-shaped cavity by ramming the first hammering device onto a top surface of the aggregate filled conical-shaped cavity may include compacting the aggregate filled conical-shaped cavity by ramming a high-frequency impact tamper onto a top surface of the aggregate filled conical-shaped cavity.

In one or more exemplary embodiments, the high-frequency impact tamper may include a rod including a first end and a second end, and a ramming head attached to the rod. In one or more exemplary embodiments, the rod may be inserted in the mechanical vibratory hammer from the first end of the rod.

In one or more exemplary embodiments, the ramming head may include a rod attaching section, a beveled-shaped ramming tip, and a cylindrical section between the rod attaching section and the beveled-shaped ramming tip. In one or more exemplary embodiments, the ramming head may be attached from the rod attaching section to the second end of the rod.

In one or more exemplary embodiments, the sixth step of covering the filled conical-shaped cavity with a layer of aggregate may include covering the filled conical-shaped cavity with one of a layer of gravel material, a layer of loose sandy soil, a layer of clayey soil, a layer of medium density soil, a layer of hard rock soil, or combination thereof.

In one or more exemplary embodiments, the seventh step of compacting the layer of aggregate by ramming the second hammering device onto a top surface of the layer of aggregate may include compacting the layer of aggregate by ramming a sheep foot compacting device onto a top surface of the layer of aggregate.

In one or more exemplary embodiments, the sheep foot compacting device may include a rod including a first end and a second end, a beveled-shaped element including a top end and a bottom end, and a reduced conical tip attached to the bottom end of the beveled-shaped element. In one or more exemplary embodiment, the beveled-shaped element may be attached from the top end of the beveled-shaped element to the second end of the rod.

In one or more exemplary embodiments, the fourth step of generating an aggregate filled conical-shaped cavity by filling the conical-shaped cavity with aggregate and the fifth step of compacting the aggregate filled conical-shaped cavity are repeated in a cycle until the top surface of the aggregate filled conical-shaped cavity reaches a predefined threshold. In one or more exemplary embodiment, the predetermined threshold may be the ground level.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well-known methods, procedures, components, and/or circuitry have been described at a relatively high-level, without detail, in order to avoid unnecessarily obscuring aspects of the present teachings. The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown but is to be accorded the widest possible scope consistent with the principles and features disclosed herein.

The present disclosure is directed to exemplary mandrels and methods for performing soil compaction at a target location. The exemplary mandrel provides a facility to forming a conical cavity at a target location. The conical cavity may further be utilized for soil compaction. On the other hand, the exemplary method may allow for compacting the soil at a target location by forming some conical cavities utilizing the exemplary mandrel. In the exemplary method, after forming the conical cavity utilizing the exemplary mandrel, the conical cavity is filled with the aggregate and then the aggregate filling the conical cavity is compacted utilizing a mechanical vibratory hammer.

Filling the conical cavity and compacting the aggregate filling the conical cavity may be repeated a few times until the aggregate level is the same as the ground level. Thereafter, the conical cavity is covered with a layer of aggregate, and then, the layer of aggregate is compacted utilizing the mechanical vibratory hammer FIG. 1A shows a perspective view of a mandrel 100 gripped by a mechanical vibratory hammer 150 for forming a cavity at a target location, consistent with one or more exemplary embodiments of the present disclosure.

Figure 1A:
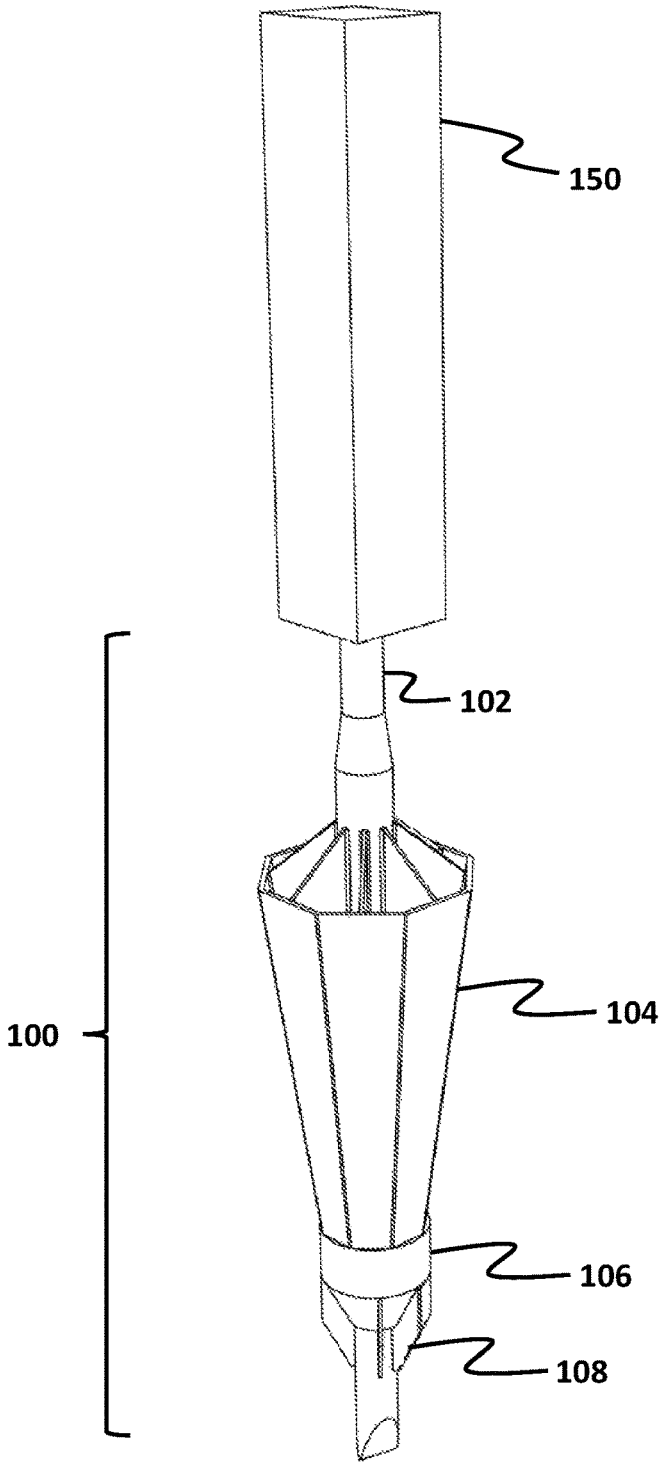
FIG. 1A illustrates a perspective view of a mandrel gripped by a mechanical vibratory hammer for forming a cavity at a target location, consistent with one or more exemplary embodiments of the present disclosure.
Figure 1B:
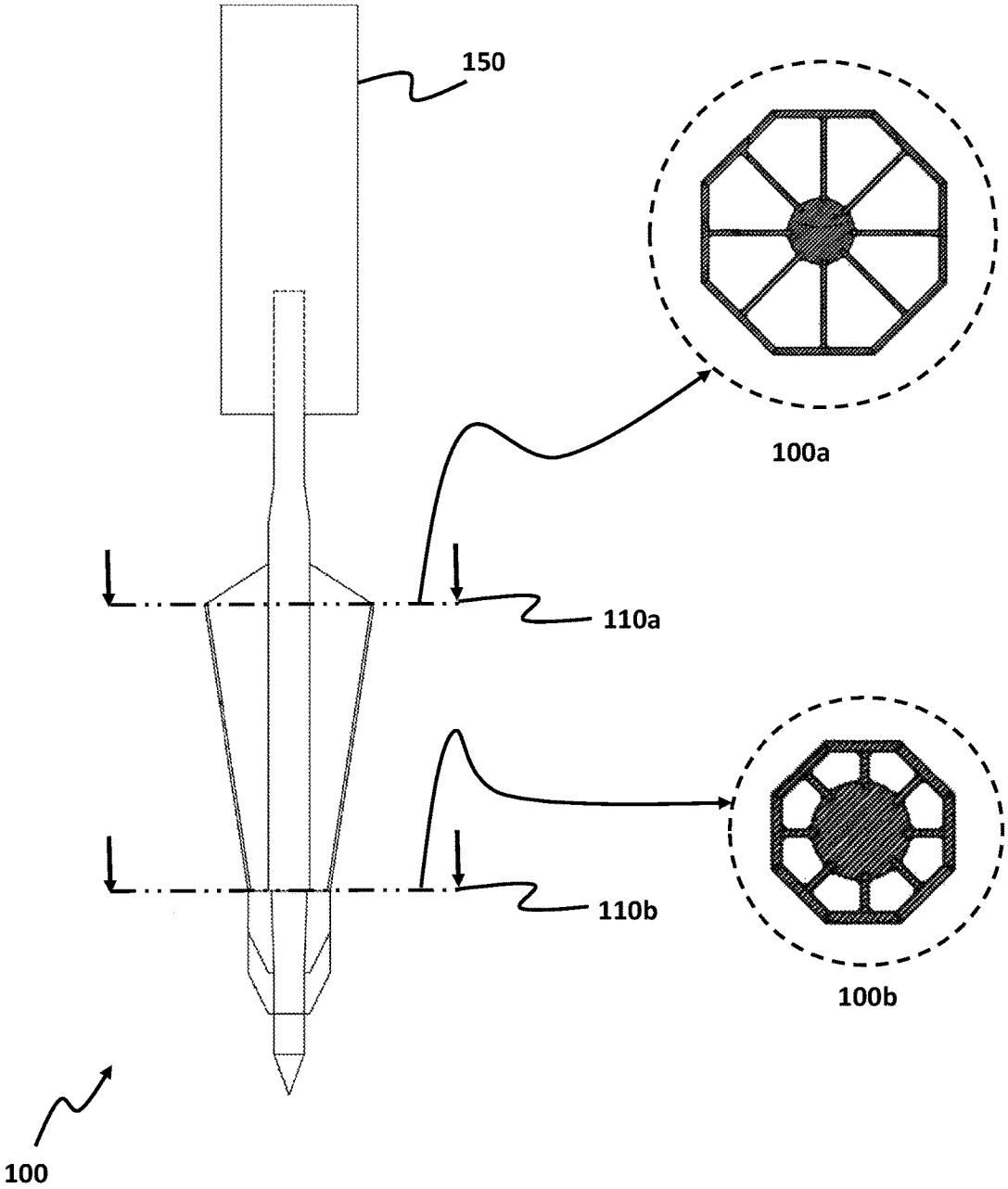
FIG. 1B illustrates a front view and two top sectional-view of a mandrel gripped by a mechanical vibratory hammer for forming a cavity at a target location, consistent with one or more exemplary embodiments of the present disclosure.

FIG. 1B shows a front view and two top sectional-view of mandrel 100 gripped by mechanical vibratory hammer 150 for forming a cavity at a target location, consistent with one or more exemplary embodiments of the present disclosure. As shown in FIG. 1A, in an exemplary embodiment, an exemplary mandrel 100 may include a main drilling shaft 102, a plurality of T-shaped elements 104, a hollow cylindrical-shaped element 106, and a plurality of parallelepiped-shaped stiffener plates 108.

Figure 2:
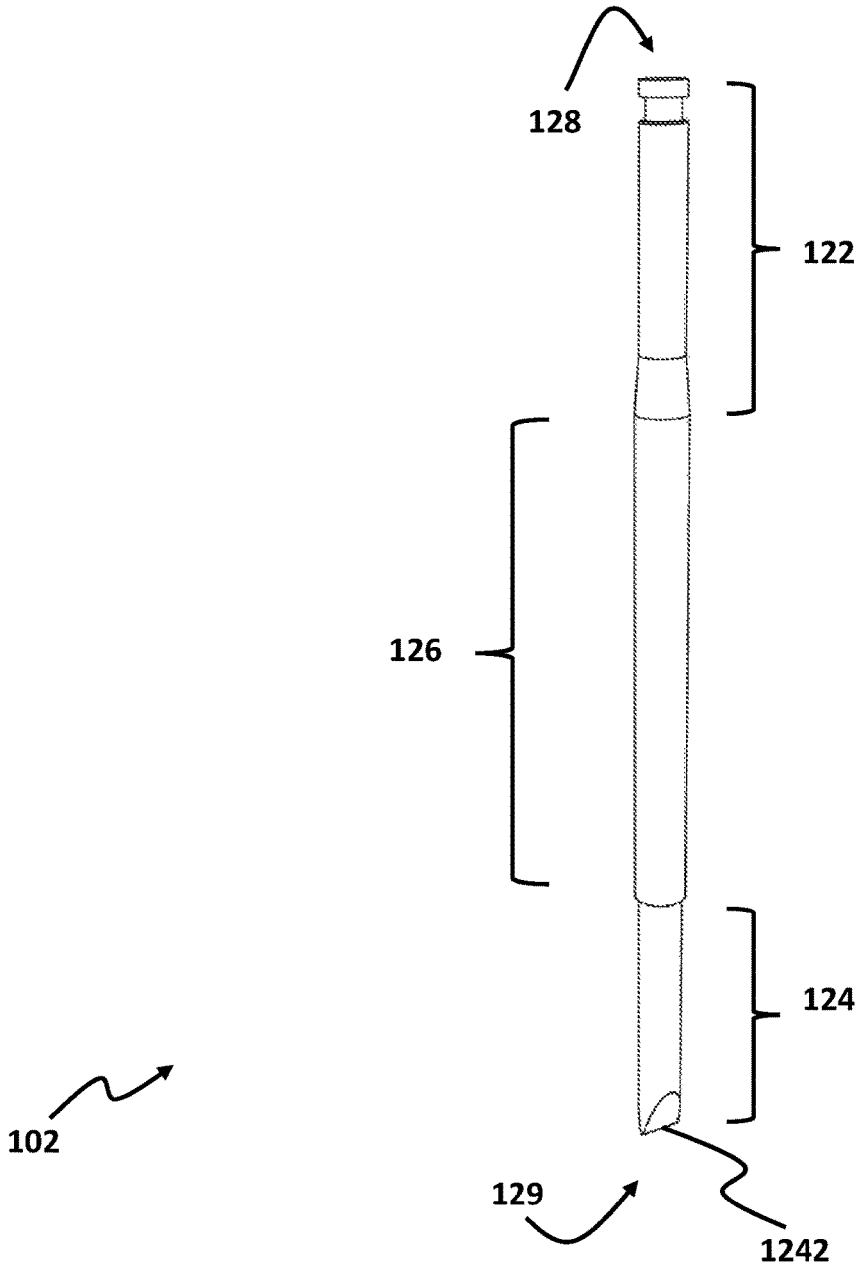
FIG. 2 illustrates a side view of a main drilling shaft of a mandrel, consistent with one or more exemplary embodiments of the present disclosure.

FIG. 2 shows a side view of main drilling shaft 102 of mandrel 100, consistent with one or more exemplary embodiments of the present disclosure. As shown in FIG. 2, in an exemplary embodiment, main drilling shaft 102 may include a hammer insertion part 122 and a bore head 124. In an exemplary embodiment, main drilling shaft 102 may include a first end 128 predicating a top part of main drilling shaft 102, and a second end 129 predicating a bottom part of main drilling shaft 102. In an exemplary embodiment, hammer insertion part 122 may be positioned at first end 128 of main drilling shaft 102 and bore head 124 may be positioned at second end 129. In an exemplary embodiment, main drilling shaft 102 may further include a medium part 126 positioned between hammer insertion part 122 and bore head 124. In an exemplary embodiment, bore head 124 may include a wedge-shaped tip 1242. In an exemplary embodiment, it may be understood that wedge-shaped tip 1242 may provide significant benefits including but not limited to a facility for tampering through hard rock surfaces and penetrating the hard parts and crushing them.

As shown in FIG. 1A, in an exemplary embodiment, plurality of T-shaped elements 104 may be mounted around main drilling shaft 102. In an exemplary embodiment, plurality of T-shaped elements 104 may be mounted adjacently around medium part 126 of main drilling shaft 102. In an exemplary embodiment, each T-shaped element of plurality of T-shaped elements 104 may be welded to an outer surface of main drilling shaft 102. Alternatively, in an exemplary embodiment, each T-shaped element of plurality of T-shaped elements 104 may be attached to the outer surface of main drilling shaft 102 utilizing any other facility and/or mechanism with similar functionality. In an exemplary embodiment, plurality of T-shaped elements 104 and main drilling shaft 102 may be manufactured seamlessly to create an integrated and/or unitary part.

As shown in FIG. 1B, plurality of T-shaped elements 104 may be mounted adjacently around medium part 126 in a way such that plurality of T-shaped elements 104 forming a closed octagonal from a top-view of mandrel 100. In an exemplary embodiment, a first size of a first top view cross-section 100*a* at a first location 110*a* from a top view of plurality of T-shaped elements 104 may be larger than a second size of a second top view cross-section 100*b* at a second location 110*b* from a top view of plurality of T-shaped elements 104. Benefits from mounting plurality of T-shaped elements adjacently around medium part 126 in a way such that plurality of T-shaped elements 104 forming a closed octagonal from a top-view of mandrel 100, with details mentioned above, may provide significant benefits including but not limited to facilitating mandrel 100 penetration into soils including hard parts and debris.

Figure 3A:
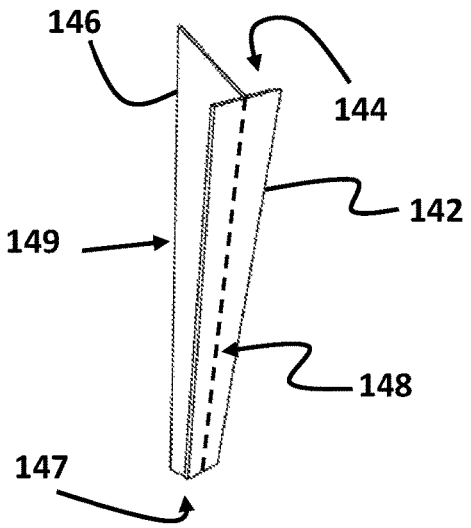
FIG. 3A illustrates a perspective view of an exemplary T-shaped element of a mandrel, consistent with one or more exemplary embodiments of the present disclosure.
Figure 3B:
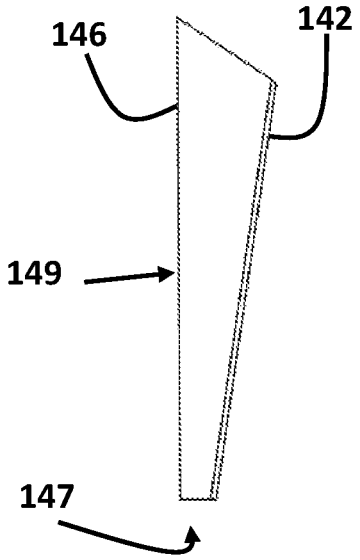
FIG. 3B illustrates a side view of an exemplary T-shaped element of a mandrel, consistent with one or more exemplary embodiments of the present disclosure.
Figure 3C:
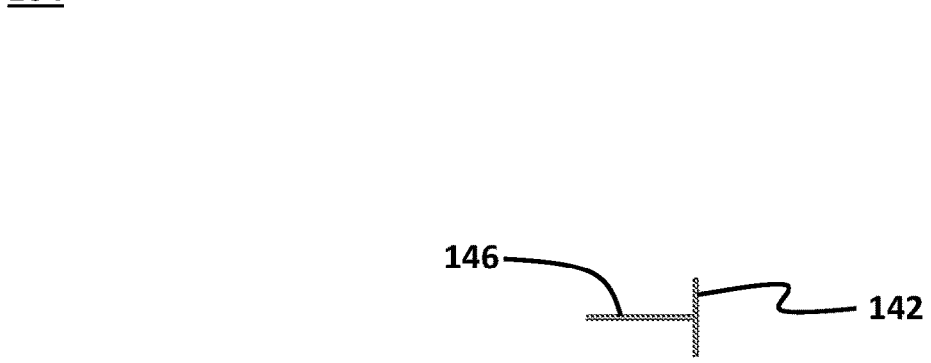
FIG. 3C illustrates a top view of an exemplary T-shaped element of a mandrel, consistent with one or more exemplary embodiments of the present disclosure.

FIG. 3A shows a perspective view of an exemplary T-shaped element of a mandrel, consistent with one or more exemplary embodiments of the present disclosure. FIG. 3B shows a side view of an exemplary T-shaped element of a mandrel, consistent with one or more exemplary embodiments of the present disclosure. FIG. 3C shows a top view of an exemplary T-shaped element of a mandrel, consistent with one or more exemplary embodiments of the present disclosure. As shown in FIG. 3A, FIG. 3B, and FIG. 3C, in an exemplary embodiment, each T-shaped element of plurality of T-shaped elements 104 may include a first trapezoid-shaped plate 142 and a second trapezoid-shaped plate 146. In an exemplary embodiment, first trapezoid-shaped plate 142 may include a trapezoid face 144. Furthermore, second trapezoid-shaped plate 146 may include a first edge 148 and a second edge 149.

In an exemplary embodiment, second trapezoid-shaped plate 146 may be attached at first edge 148 of second trapezoid-shaped plate 146 to trapezoid face 144 of first trapezoid-shaped plate 142. In an exemplary embodiment, second trapezoid-shaped plate 146 may be welded at first edge 148 of second trapezoid-shaped plate 146 to trapezoid face 144 of first trapezoid-shaped plate 142. Alternatively, in an exemplary embodiment, second trapezoid-shaped plate 146 may be attached at first edge 148 of second trapezoid-shaped plate 146 to trapezoid face 144 of first trapezoid-shaped plate 142 utilizing any other facility and/or mechanism with similar functionality. In an exemplary embodiment, second trapezoid-shaped plate 146 and trapezoid face 144 of first trapezoid-shaped plate 142 may be manufactured seamlessly to create an integrated and/or unitary part.

Figure 4A:
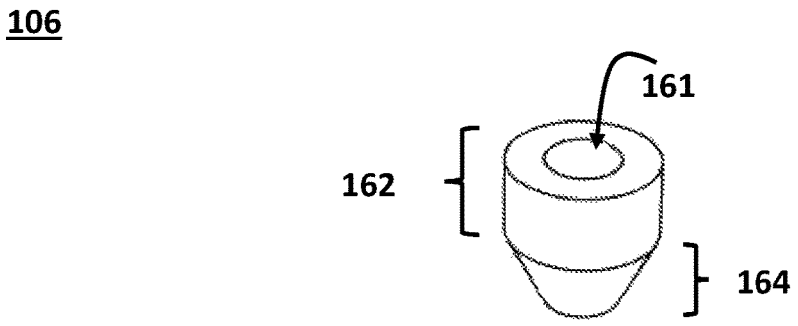
FIG. 4A illustrates a perspective view of a hollow cylindrical-shaped element, consistent with one or more exemplary embodiments of the present disclosure.
Figure 4B:
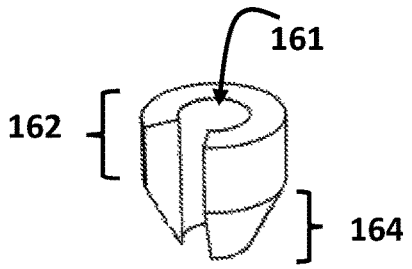
FIG. 4B illustrates a cut-out view of a hollow cylindrical-shaped element, consistent with one or more exemplary embodiments of the present disclosure.
Figure 4C:
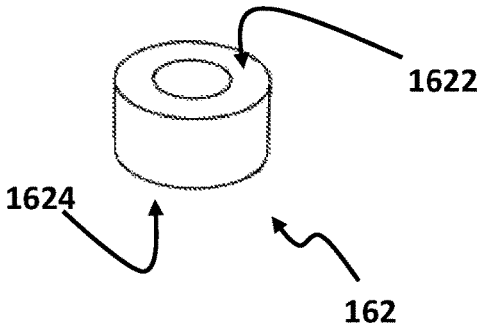
FIG. 4C illustrates a perspective view of a hollow-cylindrical section, consistent with one or more exemplary embodiments of the present disclosure.
Figure 4D:
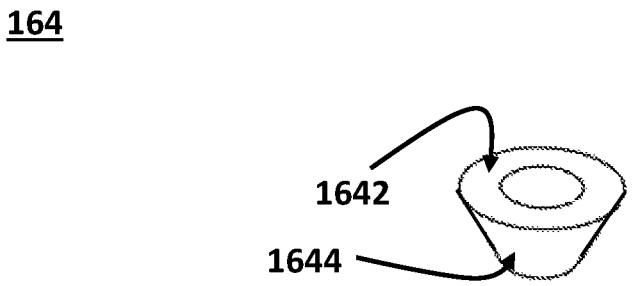
FIG. 4D illustrates a perspective view of a hollow-beveled section, consistent with one or more exemplary embodiments of the present disclosure.

FIG. 4A shows a perspective view of a hollow cylindrical-shaped element, consistent with one or more exemplary embodiments of the present disclosure. FIG. 4B shows a cut-out view of a hollow cylindrical-shaped element, consistent with one or more exemplary embodiments of the present disclosure. FIG. 4C shows a perspective view of a hollow-cylindrical section, consistent with one or more exemplary embodiments of the present disclosure. FIG. 4D shows a perspective view of a hollow-beveled section, consistent with one or more exemplary embodiments of the present disclosure. As shown in FIG. 1A, in an exemplary embodiment, hollow-cylindrical shaped element 106 may be mounted onto main drilling shaft 102. In an exemplary embodiment, hollow-cylindrical shaped element 106 may be firmly mounted onto medium part 126 of main drilling shaft 102 such that any movement of hollow-cylindrical shaped element 106 relative to main drilling shaft 102 is minimized or otherwise prevented.

As further shown in FIGS. 4A-D, in an exemplary embodiment, hollow cylindrical-shaped element 106 may include a main drilling shaft insertion hole 161, a hollow-cylindrical section 162, and a hollow-beveled section 164. In an exemplary embodiment, hollow cylindrical-shaped element 106 may be configured to be mounted onto medium part 126 of main drilling shaft 102 through main drilling shaft insertion hole 161. In an exemplary embodiment, hollow-cylindrical section 162 may include a top surface 1622 and a bottom surface 1624. In an exemplary embodiment, as shown in FIG. 1A, hollow cylindrical-shaped element 106 may be attached at top surface 1622 of hollow-cylindrical section 162 to a bottom end of plurality of T-shaped elements 108.

In an exemplary embodiment, hollow-beveled section 164 may include a large-diameter circular surface 1642 and an outer beveled surface 1644. In an exemplary embodiment, hollow-beveled section 164 may be attached at large-diameter circular surface 1642 to bottom surface 1624 of hollow-cylindrical section 162.

Figure 5:
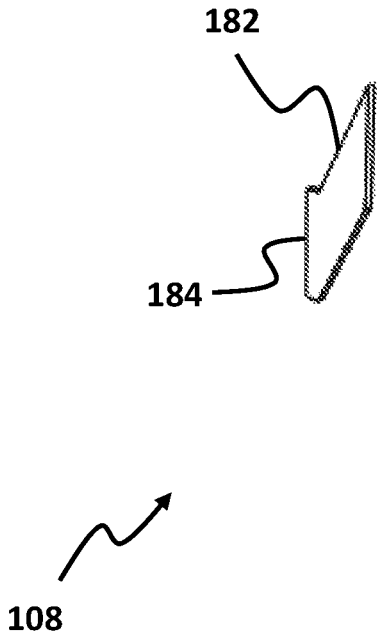
FIG. 5 illustrates a perspective view of a parallelepiped-shaped stiffener plate, consistent with one or more exemplary embodiments of the present disclosure.

As shown in FIG. 1A, in an exemplary embodiment, plurality of parallelepiped-shaped stiffener plates 108 may be mounted around medium part 126 of main drilling shaft 102. FIG. 5 shows a perspective view of parallelepiped-shaped stiffener plate 108, consistent with one or more exemplary embodiments of the present disclosure. As shown in FIG. 5, in an exemplary embodiment, each respective parallelepiped-shaped stiffener plate from plurality of parallelepiped-shaped stiffener plates 108 may include a third edge 182 and a fourth edge 184. In an exemplary embodiment, each respective parallelepiped-shaped stiffener plate 108 may be attached at respective third edge 182 to outer beveled surface 1644 of hollow-beveled section. In an exemplary embodiment, each respective parallelepiped stiffener plate 108 may also be attached at respective fourth edge 184 to medium part 126 of main drilling shaft 102.

Figure 6A:
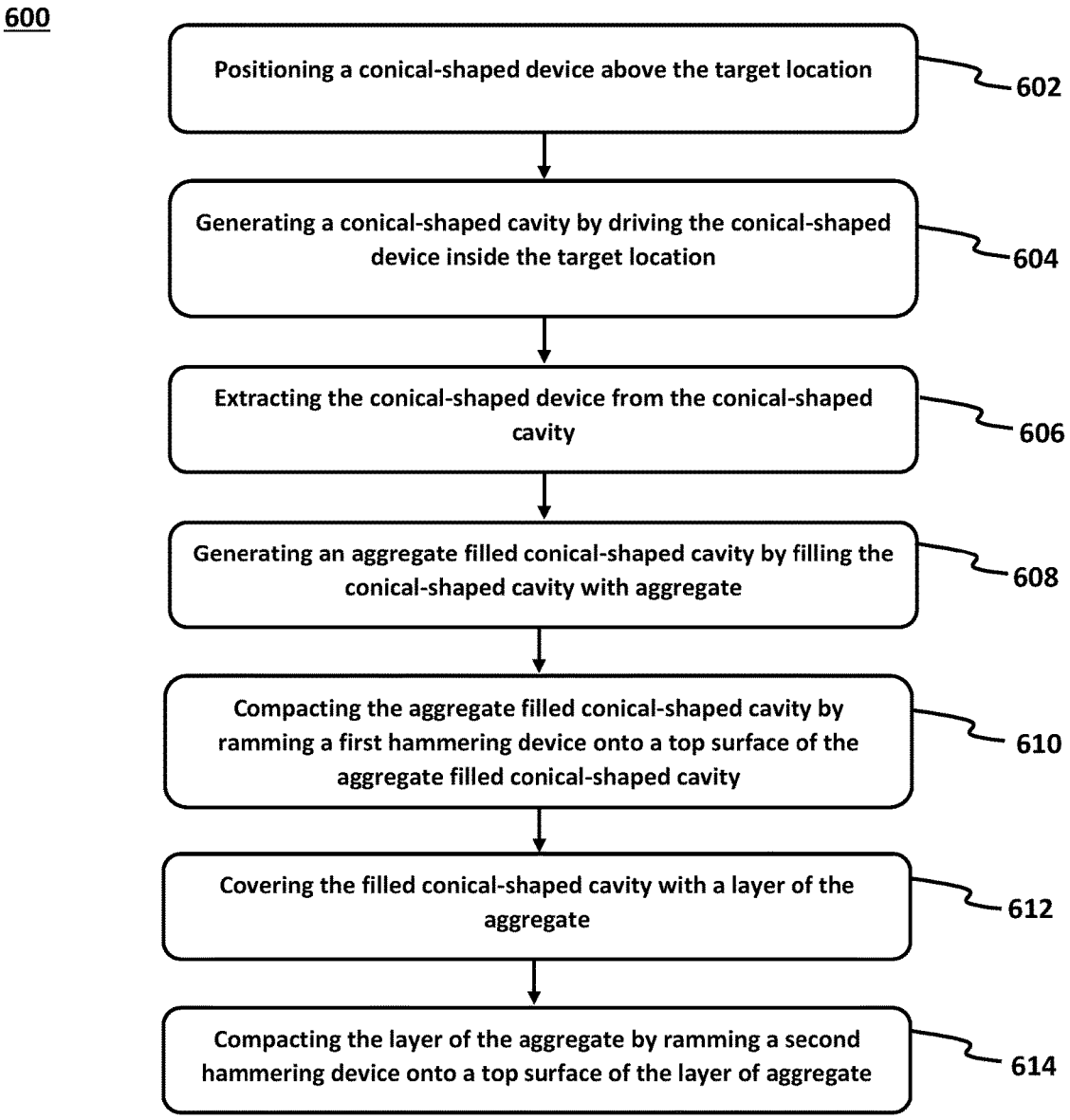
FIG. 6A illustrates a method for soil compaction at a target location, consistent with one or more exemplary embodiments of the present disclosure.
Figure 6B:
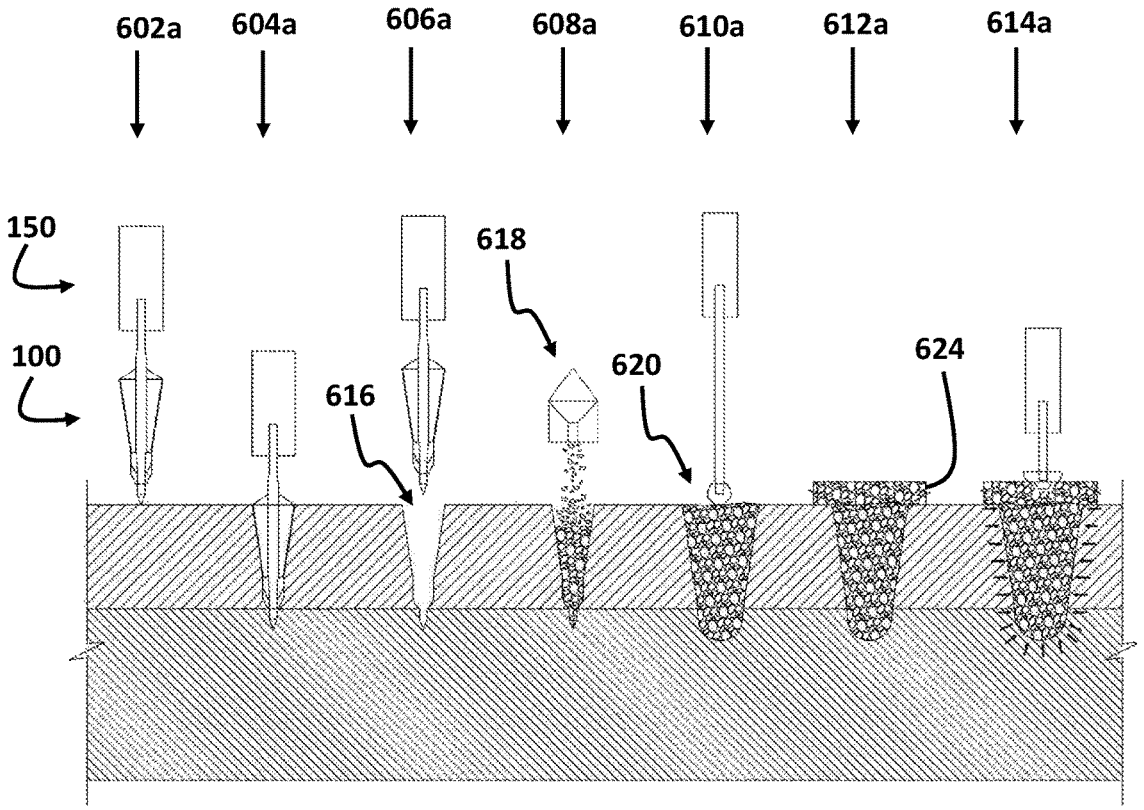
FIG. 6B illustrates a schematic implementation of an exemplary method for soil compaction at a target location, consistent with one or more exemplary embodiments of the present disclosure.

FIG. 6A is a method 600 for soil compaction at a target location, consistent with one or more exemplary embodiments of the present disclosure. FIG. 6B shows a schematic implementation of method 600 for soil compaction at a target location, consistent with one or more exemplary embodiments of the present disclosure. As shown in FIG. 6A, in an exemplary embodiment, method 600 may include step 602 of positioning a conical-shaped device above the target location. In an exemplary embodiment, step 602*a* in FIG. 6B corresponds to step 602 in FIG. 6A. In an exemplary embodiment, the conical-shaped device utilized in step 602 of method 600 may be substantially analogous in structure and functionality to a mandrel 100 as shown in FIGS. 1A and 1B.

As shown in FIG. 1A , in an exemplary embodiment, an exemplary mandrel 100 may include a main drilling shaft 102, a plurality of T-shaped elements 104, a hollow cylindrical-shaped element 106, and a plurality of parallelepiped-shaped stiffener plates 108.

FIG. 2 shows a side view of main drilling shaft 102 of mandrel 100, consistent with one or more exemplary embodiments of the present disclosure. As shown in FIG. 2, in an exemplary embodiment, main drilling shaft 102 may include a hammer insertion part 122 and a bore head 124. In an exemplary embodiment, main drilling shaft 102 may include a first end 128 predicating a top part of main drilling shaft 102 and a second end 129 predicating a bottom part of main drilling shaft 102. In an exemplary embodiment, hammer insertion part 122 may be positioned at first end 128 of main drilling shaft 102 and bore head 124 may be positioned at second end 129. In an exemplary embodiment, main drilling shaft 102 may further include a medium part 126 positioned between hammer insertion part 122 and bore head 124. In an exemplary embodiment, bore head 124 may include a wedge-shaped tip 1242. In an exemplary embodiment, it may be understood that wedge-shaped tip 1242 may provide significant benefits including but not limited to a facility for tampering through hard rock surfaces and penetrating the hard parts and crushing them.

As shown in FIG. 1A, in an exemplary embodiment, plurality of T-shaped elements 104 may be mounted around main drilling shaft 102. In an exemplary embodiment, plurality of T-shaped elements 104 may be mounted adjacently around medium part 126 of main drilling shaft 102. In an exemplary embodiment, each T-shaped element of plurality of T-shaped elements 104 may be welded to an outer surface of main drilling shaft 102. Alternatively, in an exemplary embodiment, each T-shaped element of plurality of T-shaped elements 104 may be attached to the outer surface of main drilling shaft 102 utilizing any other facility and/or mechanism with similar functionality. In an exemplary embodiment, plurality of T-shaped elements 104 and main drilling shaft 102 may be manufactured seamlessly to create an integrated and/or unitary part.

As shown in FIG. 1B, plurality of T-shaped elements 104 may be mounted adjacently around medium part 126 in a way such that plurality of T-shaped elements 104 forming a closed octagonal from a top-view of mandrel 100. In an exemplary embodiment, a first size of a first top view cross-section 100*a* at a first location 110*a* from a top view of plurality of T-shaped elements 104 may be larger than a second size of a second top view cross-section 100*b* at a second location 110*b* from a top view of plurality of T-shaped elements 104. Benefits from mounting plurality of T-shaped elements adjacently around medium part 126 in a way such that plurality of T-shaped elements 104 form a closed octagonal from a top-view of mandrel 100, with details mentioned above, may provide significant benefits including, but not limited to, facilitating mandrel 100 penetration into soils including hard parts and debris.

FIG. 3A shows a perspective view of an exemplary T-shaped element of a mandrel, consistent with one or more exemplary embodiments of the present disclosure. FIG. 3B shows a side view of an exemplary T-shaped element of a mandrel, consistent with one or more exemplary embodiments of the present disclosure. FIG. 3C shows a top view of an exemplary T-shaped element of a mandrel, consistent with one or more exemplary embodiments of the present disclosure. As shown in FIGS. 3A-C, in an exemplary embodiment, each T-shaped element of plurality of T-shaped elements 104 may include a first trapezoid-shaped plate 142 and a second trapezoid-shaped plate 146. In an exemplary embodiment, first trapezoid-shaped plate 142 may include a trapezoid face 144. Furthermore, second trapezoid-shaped plate 146 may include a first edge 148 and a second edge 149.

In an exemplary embodiment, second trapezoid-shaped plate 146 may be attached at first edge 148 of second trapezoid-shaped plate 146 to trapezoid face 144 of first trapezoid-shaped plate 142. In an exemplary embodiment, second trapezoid-shaped plate 146 may be welded at first edge 148 of second trapezoid-shaped plate 146 to trapezoid face 144 of first trapezoid-shaped plate 142. Alternatively, in an exemplary embodiment, second trapezoid-shaped plate 146 may be attached at first edge 148 of second trapezoid-shaped plate 146 to trapezoid face 144 of first trapezoid-shaped plate 142 utilizing any other facility and/or mechanism with similar functionality. In an exemplary embodiment, second trapezoid-shaped plate 146 and trapezoid face 144 of first trapezoid-shaped plate 142 may be manufactured seamlessly to create an integrated and/or unitary part.

FIG. 4A shows a perspective view of a hollow cylindrical-shaped element, consistent with one or more exemplary embodiments of the present disclosure. FIG. 4B shows a cut-out view of a hollow cylindrical-shaped element, consistent with one or more exemplary embodiments of the present disclosure. FIG. 4C shows a perspective view of a hollow-cylindrical section, consistent with one or more exemplary embodiments of the present disclosure. FIG. 4D shows a perspective view of a hollow-beveled section, consistent with one or more exemplary embodiments of the present disclosure. As shown in FIG. 1A, in an exemplary embodiment, hollow-cylindrical shaped element 106 may be mounted onto main drilling shaft 102. In an exemplary embodiment, hollow-cylindrical shaped element 106 may be firmly mounted onto medium part 126 of main drilling shaft 102 such that any movement of hollow-cylindrical shaped element 106 relative to main drilling shaft 102 is minimized or otherwise prevented.

As shown in FIGS. 4A-D, in an exemplary embodiment, hollow cylindrical-shaped element 106 may include a main drilling shaft insertion hole 161, a hollow-cylindrical section 162, and a hollow-beveled section 164. In an exemplary embodiment, hollow cylindrical-shaped element 106 may be configured to be mounted onto medium part 126 of main drilling shaft 102 through main drilling shaft insertion hole 161. In an exemplary embodiment, hollow-cylindrical section 162 may include a top surface 1622 and a bottom surface 1624. In an exemplary embodiment, as shown in FIG. 1A, hollow cylindrical-shaped element 106 may be attached at top surface 1622 of hollow-cylindrical section 162 to a bottom end of plurality of T-shaped elements 108.

In an exemplary embodiment, hollow-beveled section 164 may include a large-diameter circular surface 1642 and an outer beveled surface 1644. In an exemplary embodiment, hollow-beveled section 164 may be attached at large-diameter circular surface 1642 to bottom surface 1624 of hollow-cylindrical section 162.

As shown in FIG. 1A, in an exemplary embodiment, plurality of parallelepiped-shaped stiffener plates 108 may be mounted around medium part 126 of main drilling shaft 102. FIG. 5 shows a perspective view of parallelepiped-shaped stiffener plate 108, consistent with one or more exemplary embodiments of the present disclosure. As shown in FIG. 5, in an exemplary embodiment, each respective parallelepiped-shaped stiffener plate from plurality of parallelepiped-shaped stiffener plates 108 may include a third edge 182 and a fourth edge 184. In an exemplary embodiment, each respective parallelepiped-shaped stiffener plate 108 may be attached at respective third edge 182 to outer beveled surface 1644 of hollow-beveled section. In an exemplary embodiment, each respective parallelepiped stiffener plate 108 may also be attached at respective fourth edge 184 to medium part 126 of main drilling shaft 102.

With the further reference to FIG. 6A, in an exemplary embodiment, method 600 may include step 604 of generating a conical-shaped cavity 616 by driving the conical-shaped device inside the target location. In an exemplary embodiment, step 604*a* in FIG. 6B corresponds to step 604 in FIG. 6A. In an exemplary embodiment, method 600 may include step 606 of extracting the conical-shaped device from the conical-shaped cavity. In an exemplary embodiment, step 606*a* in FIG. 6B corresponds to step 606 in FIG. 6A. In an exemplary embodiment, method 600 may also include step 608 of generating an aggregate filled conical-shaped cavity 620 by filling the conical-shaped cavity with aggregate. In an exemplary embodiment, step 608*a* in FIG. 6B corresponds to step 608 in FIG. 6A. For purpose of reference, it may be understood that the aggregate may include one of a gravel material, a loose sandy soil, a clayey soil, a medium density soil, a hard rock soil, and combination thereof. As shown in FIG. 6B, in an exemplary embodiment, generating the aggregate filled conical-shaped cavity 620 by filling the conical-shaped cavity with the aggregate may be implemented utilizing a hopper 618.

Figure 7:
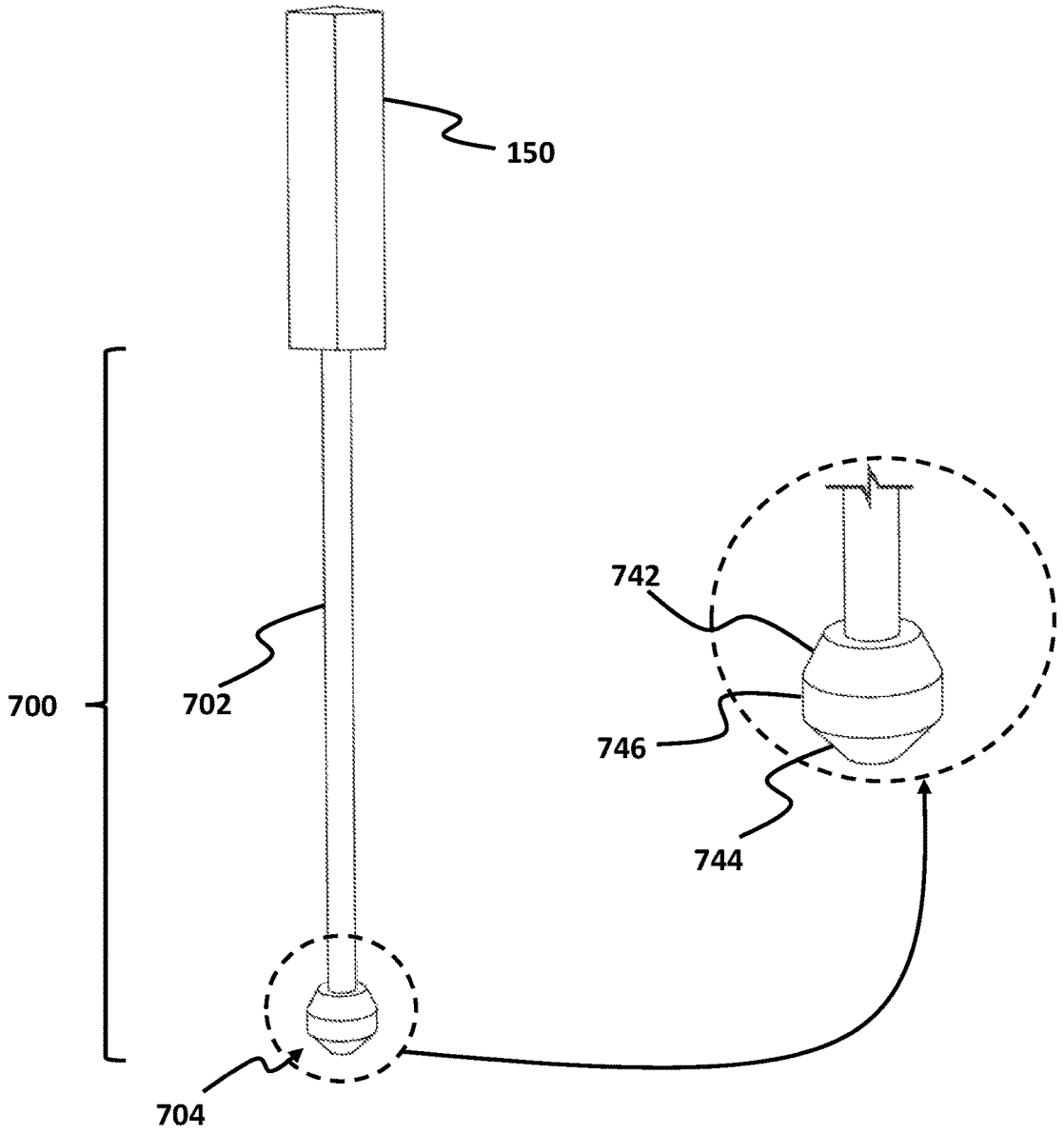
FIG. 7 illustrates a high-frequency impact tamper gripped by a mechanical vibratory hammer, consistent with one or more exemplary embodiments of the present disclosure.

In an exemplary embodiment, method 600 may further include step 610 of compacting aggregate filled conical-shaped cavity 620 by ramming a first hammering device onto a top surface of aggregate filled conical-shaped cavity 620. In an exemplary embodiment, step 610*a* in FIG. 6B corresponds to step 610 in FIG. 6A. FIG. 7 shows a high-frequency impact tamper gripped by a mechanical vibratory hammer, consistent with one or more exemplary embodiments of the present disclosure. In an exemplary embodiment, the first hammering device utilized in step 610 of method 600 may be substantially analogous in structure and functionality to a high-frequency impact tamper 700 as shown in FIG. 7.

As shown in FIG. 7, in an exemplary embodiment, high-frequency impact tamper 700 may include a first rod 702 and a ramming head 704. In an exemplary embodiment, first rod 702 may include a first end and a second end. In an exemplary embodiment, first rod 702 may be inserted in mechanical vibratory hammer 150 from the first end of first rod 702. In an exemplary embodiment, ramming head 704 may include a first rod attaching section 742, a beveled-shaped ramming tip 744, and a cylindrical section 746.

In an exemplary embodiment, first rod ramming head 704 may be attached from first rod attaching section 742 to the second end of first rod 702. As shown in FIG. 7, in an exemplary embodiment, cylindrical section 746 may be positioned between first rod attaching section 742 and beveled-shaped ramming tip 744.

Figure 8:
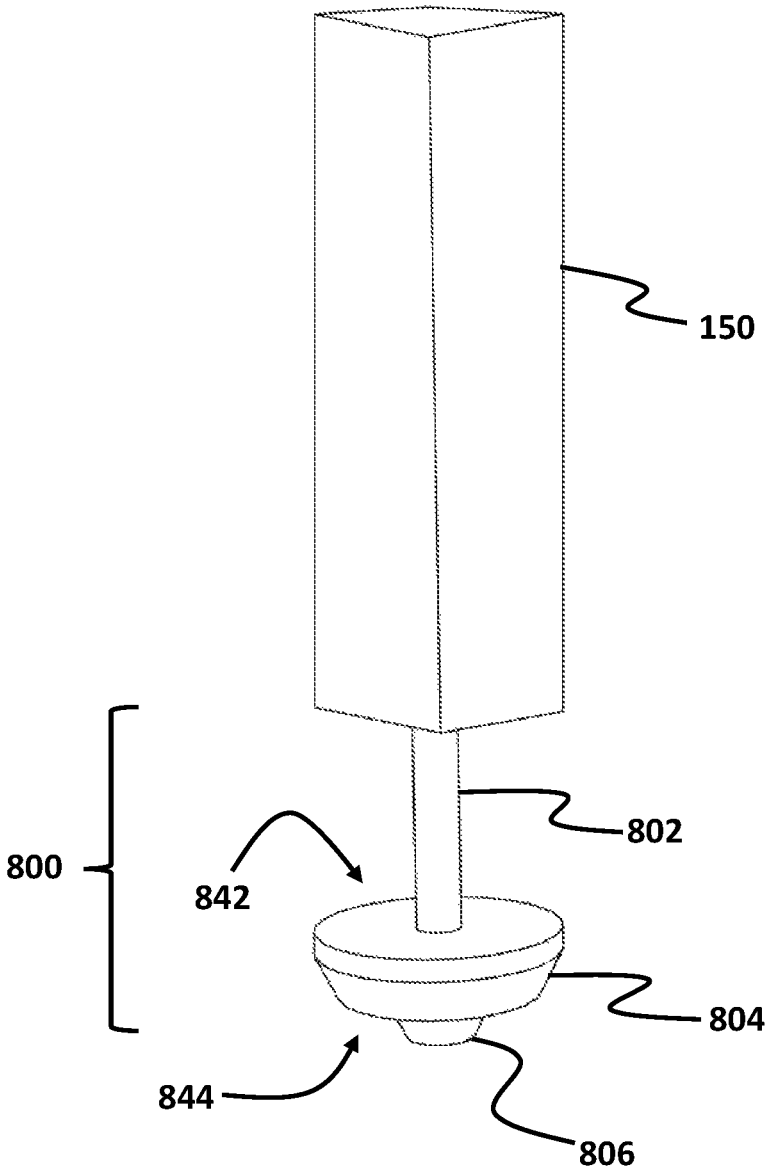
FIG. 8 illustrates a sheep foot compacting device gripped by a mechanical vibratory hammer, consistent with one or more exemplary embodiments of the present disclosure.

With the further reference to FIG. 6A, in an exemplary embodiment, method 600 may also include a step 612 of covering the conical-shaped cavity with a layer of the aggregate 624 and a step 614 of compacting the layer of aggregate 624 by ramming a second hammering device onto a top surface of the layer of aggregate 624. In an exemplary embodiment, step 612*a* and step 612*b* in FIG. 6B corresponds respectively to step 612 and 614 in FIG. 6A. For purpose of reference, it may be understood that the layer of aggregate 624 may include one of a layer of gravel material, a layer of loose sandy soil, a layer of clayey soil, a layer of medium density soil, a layer of hard rock soil, and combination thereof. FIG. 8 shows a sheep foot compacting device gripped by a mechanical vibratory hammer, consistent with one or more exemplary embodiments of the present disclosure. In an exemplary embodiment, the second hammering device utilized in step 614 of method 600 may be substantially analogous in structure and functionality to a sheep foot compacting device 800 as shown in FIG. 8.

As shown in FIG. 8, in an exemplary embodiment, sheep foot compacting device 800 may include a second rod 802, a beveled-shaped element 804, and a reduced conical tip 806. In an exemplary embodiment, second rod 802 may include a first end and a second end. In an exemplary embodiment, second rod 802 may be inserted into mechanical vibratory hammer 150 from the first end of second rod 802. In an exemplary embodiment, beveled-shaped element 804 may include a top end 842 and a bottom end 844. In an exemplary embodiment, beveled-shaped element 804 may be attached from top end 842 of beveled-shaped element 804 to the second end of second rod 802. In an exemplary embodiment, reduced conical tip 806 may be attached to bottom end 844 of beveled-shaped element.

In an exemplary embodiment, step 608 of generating aggregate filled conical-shaped cavity 620 by filling the conical-shaped cavity with aggregate, and step 610 of compacting aggregate filled conical-shaped cavity 620 by ramming a first hammering device onto a top surface of aggregate filled conical-shaped cavity 620 may be repeated in a cycle until the top surface of aggregate filled conical-shaped cavity 620 reaches a predefined threshold. For example, in an exemplary embodiment, step 608 of generating an aggregate filled conical-shaped cavity 620 by filling the conical-shaped cavity with aggregate, and step 610 of compacting aggregate filled conical-shaped cavity 620 by ramming a first hammering device onto a top surface of aggregate filled conical-shaped cavity 620 may be repeated in a cycle until the top surface of aggregate filled conical-shaped cavity 620 reaches the ground level. Benefits from repeating step 608 and step 610 of method 600 including but are not limited to improving the soil compaction process through ensuring that aggregate filled conical-shaped cavity 620 is filled with an enough amount of the aggregate. For purpose of reference, it may be understood that scant aggregate in the filled conical-shaped cavity 620 may lead to an inapplicable soil compaction While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study, except where specific meanings have otherwise been set forth herein. Relational terms such as "first" and "second" and the like may be used solely to distinguish one entity or action from another without necessarily requiring or implying any actual such relationship or order between such entities or actions. The terms "comprises," "comprising," or any other variation thereof, as used herein and in the appended claims are intended to cover a non-exclusive inclusion, encompassing a process, method, article, or apparatus that comprises a list of elements that does not include only those elements but may include other elements not expressly listed to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is not intended to be used to interpret or limit the scope or meaning of the claims. In addition, in the foregoing Detailed Description, it can be seen that various features are grouped together in various implementations. Such grouping is for purposes of streamlining this disclosure and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into this Detailed Description, with each claim standing on its own as a separately claimed subject matter.

While various implementations have been described, the description is intended to be exemplary, rather than limiting and it will be apparent to those of ordinary skill in the art that many more implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in the light of the attached claims and their equivalents. Also, various modifications and changes may be made within the scope of the attached claims.

What is claimed is:

1. A mandrel for forming a cavity at a target location, the mandrel comprising:

a main drilling shaft comprising a cylindrical-shaped structure, the main drilling shaft comprising:

a hammer insertion part positioned at a first end of the main drilling shaft;

a bore head positioned at a second end of the main drilling shaft, the bore head being configured to tamper through hard rock surfaces; and a medium part positioned between the hammer insertion part and the bore head;

a plurality of T-shaped elements mounted adjacently around the medium part, the plurality of T-shaped elements forming a closed octagonal from a top-view of the mandrel, wherein:

a first size of a first cross-section at a first location from a top-view of the plurality of T-shaped elements around the medium part is larger than a second size of a second cross-section at a second location from the top-view, the first location closer to the hammer insertion part and the second location closer to the bore head; and each respective T-shaped element of the plurality of T-shaped elements comprising:

a first trapezoid-shaped plate comprising a trapezoid face; and a second trapezoid-shaped plate comprising a first edge and a second edge, the second trapezoid-shaped plate attached at the first edge of the second trapezoid-shaped plate to the trapezoid face of the first trapezoid-shaped plate;

a hollow cylindrical-shaped element mounted onto the main drilling shaft, the hollow cylindrical-shaped element comprising:

a main drilling shaft insertion hole;

a hollow-cylindrical section comprising a top surface and a bottom surface; and a hollow-beveled section comprising a large-diameter circular surface and an outer beveled surface, the hollow-beveled section attached at the large-diameter circular surface to the bottom surface of the hollow cylindrical section; and a plurality of parallelepiped-shaped stiffener plates mounted around the medium part of the main drilling shaft, each respective parallelepiped-shaped stiffener plate of the plurality of parallelepiped-shaped stiffener plates comprising a third edge and a fourth edge, each parallelepiped-shaped stiffener plate of the plurality of parallelepiped-shaped stiffener plates attached at the respective third edge to the outer beveled surface of the hollow-beveled section and attached at the respective fourth edge to the medium part of the main drilling shaft.

2. The mandrel of claim 1, wherein the hollow cylindrical-shaped element attached at the top surface of the hollow-cylindrical section to a bottom end of the plurality of T-shaped elements.

3. The mandrel of claim 1, wherein the bore head comprises a wedge-shaped tip.

4. The mandrel of claim 1, wherein a diameter of the hammer insertion part corresponds to a size of a mechanical vibratory hammer.

5. A method for soil compaction at a target location, the method comprising:

positioning a mandrel above the target location, the mandrel comprising:

a main drilling shaft comprising a cylindrical-shaped structure, the main drilling shaft comprising:

a hammer insertion part positioned at a first end of the main drilling shaft;

a bore head positioned at a second end of the main drilling shaft, the bore head being configured to tamper through hard rock surfaces; and a medium part positioned between the hammer insertion part and the bore head;

a plurality of T-shaped elements attached around the medium part of the main drilling shaft, the plurality of T-shaped elements forming a closed octagonal from a top-view of the mandrel, wherein:

a first size of a first cross-section at a first location from a top-view of the plurality of T-shaped elements around the medium part is larger than a second size of a second cross section at a second location from the top-view, the first location closer to the hammer insertion part and the second location closer to the bore head; and each respective T-shaped element from the plurality of T-shaped elements comprising:

a first trapezoid-shaped plate comprising a trapezoid face;

a second trapezoid-shaped plate comprising a first edge and a second edge, the second trapezoid-shaped plate attached from the first edge of the second trapezoid-shaped plate to the trapezoid face of the first trapezoid-shaped plate;

a hollow cylindrical-shaped element mounted onto the main drilling shaft, the hollow cylindrical-shaped element comprising:

a hollow-cylindrical section comprising a top surface and a bottom surface;

a hollow-beveled section comprising a large-diameter circular surface and an outer beveled surface, the hollow-beveled section attached from the large-diameter circular surface to the bottom surface of the hollow cylindrical section;

a plurality of parallelepiped-shaped stiffener plates, each respective parallelepiped-shaped stiffener plate from the plurality of parallelepiped-shaped stiffener plates comprising a third edge and a fourth edge, wherein the parallelepiped-shaped stiffener plate is attached from the third edge to the outer beveled surface of the hollow-beveled section and attached from the fourth edge to the medium part of the main drilling shaft;

generating a conical-shaped cavity by driving the mandrel into the target location;

extracting the mandrel from the conical-shaped cavity;

generating an aggregate filled conical-shaped cavity by filling the conical-shaped cavity with aggregate;

compacting the aggregate filled conical-shaped cavity by ramming a first hammering device onto a top surface of the aggregate filled conical-shaped cavity;

covering the filled conical-shaped cavity with a layer of the aggregate;

compacting the layer of the aggregate by ramming a second hammering device onto a top surface of the layer of the aggregate.

6. A method for soil compaction at a target location, the method comprising:

positioning a conical-shaped device above the target location;

generating a conical-shaped cavity by driving the conical-shaped device into the target location;

extracting the conical-shaped device from the conical-shaped cavity;

generating an aggregate filled conical-shaped cavity by filling the conical-shaped cavity with aggregate;

compacting the aggregate filled conical-shaped cavity by ramming a first hammering device onto a top surface of the aggregate filled conical-shaped cavity;

covering the filled conical-shaped cavity with a layer of the aggregate; and compacting the layer of the aggregate by ramming a second hammering device onto a top surface of the layer of the aggregate, wherein the ramming the first hammer device and the ramming the second hammering device comprises respectively ramming in a vertical direction.

7. The method of claim 6, wherein positioning the conical-shaped device above the target location comprises positioning a mandrel above the target location, the mandrel comprising:

a main drilling shaft comprising a cylindrical-shaped structure, the main drilling shaft comprising:

a hammer insertion part positioned at a first end of the main drilling shaft;

a bore head positioned at a second end of the main drilling shaft, the bore head being configured to tamper through hard rock surfaces; and a medium part positioned between the hammer insertion part and the bore head;

a plurality of T-shaped elements mounted around the medium part of the main drilling shaft, the plurality of T-shaped elements forming a closed octagonal from a top-view of the mandrel, wherein each respective T-shaped element from the plurality of T-shaped elements comprising:

a first trapezoid-shaped plate comprising a trapezoid face;

a second trapezoid-shaped plate comprising a first edge and a second edge, the second trapezoid-shaped plate attached from the first edge of the second trapezoid-shaped plate to the trapezoid face of the first trapezoid-shaped plate;

a hollow cylindrical-shaped element mounted onto the main drilling shaft, the hollow cylindrical-shaped element comprising:

a hollow-cylindrical section comprising a top surface and a bottom surface;

a hollow-beveled section comprising a large-diameter circular surface and an outer beveled surface, the hollow-beveled section attached from the large-diameter circular surface to the bottom surface of the hollow cylindrical section;

a plurality of parallelepiped-shaped stiffener plates, each respective parallelepiped-shaped stiffener plate from the plurality of parallelepiped-shaped stiffener plates comprising a third edge and a fourth edge, wherein each respective parallelepiped-shaped stiffener plate is attached at the respective third edge to the outer beveled surface of the hollow-beveled section and attached at the respective fourth edge to the medium part of the main drilling shaft.

8. The method of claim 7, wherein the bore head comprises a wedge-shaped tip.

9. The method of claim 7, wherein the plurality of T-shaped elements are mounted adjacently around the medium part of the main drilling shaft, the plurality of T-shaped elements forming a closed octagonal from a top view of the mandrel.

10. The method of claim 7, wherein the hollow cylindrical-shaped element attached at the top surface of the hollow-cylindrical section to a bottom end of the plurality of T-shaped elements.

11. The method of claim 7, wherein a diameter of the hammer insertion part corresponds to a size of a mechanical vibratory hammer.

12. The method of claim 6, wherein generating a conical-shaped cavity by driving the conical-shaped device inside the target location comprises generating a conical-shaped cavity by driving the conical-shaped device into the target location utilizing a mechanical vibratory hammer.

13. The method of claim 6, wherein extracting the conical-shaped device from the conical-shaped cavity comprises extracting the conical-shaped device from the conical-shaped cavity utilizing a mechanical vibratory hammer.

14. The method of claim 6, wherein generating an aggregate filled conical-shaped cavity comprises filling the conical-shaped cavity with one of a gravel material, a loose sandy soil, a clayey soil, a medium density soil, a hard rock soil, and combination thereof.

15. The method of claim 6, wherein compacting the aggregate filled conical-shaped cavity by ramming the first hammering device onto a top surface of the aggregate filled conical-shaped cavity comprises compacting the aggregate filled conical-shaped cavity by ramming a high-frequency impact tamper onto a top surface of the aggregate filled conical-shaped cavity, the high-frequency impact tamper comprising:

a rod comprising a first end and a second end, the rod being inserted in a mechanical vibratory hammer from the first end of the rod; and a ramming head attached to the rod; the ramming head comprising:

a rod attaching section, wherein the ramming head attached from the rod attaching section to the second end of the rod;

a beveled-shaped ramming tip; and a cylindrical section positioned between the rod attaching section and the beveled-shaped ramming tip.

16. The method of claim 6, wherein covering the filled conical-shaped cavity with a layer of aggregate on the ground comprises covering the filled conical-shaped cavity with one of a layer of gravel material, a layer of loose sandy soil, a layer of clayey soil, a layer of medium density soil, a layer of hard rock soil, or combination thereof.

17. The method of claim 6, wherein compacting the layer of aggregate by ramming the second hammering device onto a top surface of the layer of aggregate comprises compacting the layer of aggregate by ramming a sheep foot compacting device onto a top surface of the layer of aggregate, the sheep foot compacting device comprising:

a rod comprising a first end and a second end, wherein the rod being inserted in a mechanical vibratory hammer from the first end of the rod;

a beveled-shaped element comprising a top end and a bottom end, the bevel-shaped element attached from the top end of the beveled-shaped element to the second end of the rod; and a reduced conical tip attached to the bottom end of the beveled-shaped element.

18. The method of claim 6, wherein generating an aggregate filled conical-shaped cavity by filling the conical-shaped cavity with aggregate and compacting the aggregate filled conical-shaped cavity are repeated in a cycle until the top surface of the aggregate filled conical-shaped cavity reaches a predefined threshold.

19. The method of claim 18, wherein the predetermined threshold is a ground level.

* * * * *